US005333352A

United States Patent [19]

McDonald, Jr.

[11] Patent Number: 5,333,352

[45] Date of Patent: Aug. 2, 1994

[54] CHAMOIS WATER EXTRACTION APPARATUS

[76] Inventor: William H. McDonald, Jr., 431 Neconi St., Bonner Springs, Kans. 66012

[21] Appl. No.: 116,707

[22] Filed: Sep. 7, 1993

[51] Int. Cl.[5] ..... A47L 13/59; B30B 9/32

[52] U.S. Cl. ..... 15/261; 15/260; 100/125; 100/132; 100/293; 100/112; 100/137; 100/283; 68/245

[58] Field of Search ..... 15/260, 261, 262, 263; 100/125, 283, 293, 132, 112, 137, 138; 68/245, 244, 241

[56] References Cited

U.S. PATENT DOCUMENTS

| | | | |
|---|---|---|---|
| 203,501 | 5/1878 | Russell | 15/261 |
| 217,519 | 7/1879 | Fanning | 100/125 |
| 444,063 | 1/1891 | Emmons | 100/125 |
| 492,259 | 2/1893 | Barrett | 100/125 |
| 525,023 | 8/1894 | Meyer | 100/125 |
| 769,015 | 8/1904 | Peirce | 100/125 |
| 1,128,732 | 2/1915 | Steinbach | 100/125 |
| 1,137,907 | 5/1915 | Roseberry | 15/261 |
| 1,149,530 | 8/1915 | Markovich | 100/283 |
| 4,168,661 | 9/1979 | Wigdahl | 100/293 |
| 4,228,734 | 10/1980 | Parrish | 100/293 |

*Primary Examiner*—Timothy F. Simone
*Assistant Examiner*—Gary K. Graham
*Attorney, Agent, or Firm*—E. Michael Combs

[57] ABSTRACT

A piston plate received within a container is provided, such that the container having an apertured container floor directs squeezed water from a chamois positioned between the piston plate and the container floor. The container is arranged for reception within a supporting plate that is further apertured, wherein an articulated linkage is arranged to project the piston plate into the container permitting periodic extraction of water from the chamois.

2 Claims, 4 Drawing Sheets 26
32
33

29
26
27
37
35
36
34
38
42
40
39
43
44
45
42
41
46
6
6

CHAMOIS WATER EXTRACTION APPARATUS

BACKGROUND OF THE INVENTION

1. Field of the Invention

The field of invention relates to water extraction apparatus, and more particularly pertains to a new and improved chamois water extraction apparatus wherein the same permits periodic removal of excessive water from a chamois to permit continued use of the chamois in a drying procedure.

2. Description of the Prior Art

Chamois and other such water absorbent fabric are typically employed by individuals in a drying procedure, wherein the water absorption characteristic of such fabrics and skins are known per se. To permit ease of continued use of the chamois and fabrics, the instant invention attempts to overcome deficiencies of the prior art by providing for a wall mounted structure permitting the chamois to be pressurized between an apertured floor and a piston to provide for periodic water extraction. The prior art has heretofore provided for complex water extraction structure such as indicated in U.S. Pat. Nos. 3,908,413; 4,180,995; and 3,924,425 as examples.

The instant invention attempts to overcome such complex apparatus providing for structure of ease of use as well as effectiveness in construction and in this respect, the present invention substantially fulfills this need.

SUMMARY OF THE INVENTION

In view of the foregoing disadvantages inherent in the known types of laundry pressing apparatus now present in the prior art, the present invention provides a chamois water extraction apparatus providing for the periodic extraction of water from an associated chamois member. As such, the general purpose of the present invention, which will be described subsequently in greater detail, is to provide a new and improved chamois water extraction apparatus which has all the advantages of the prior art water extraction apparatus and none of the disadvantages.

To attain this, the present invention provides a piston plate received within a container, such that the container having an apertured container floor directs squeezed water from the chamois positioned between the piston plate and the container floor. The container is arranged for reception with a supporting plate that is further apertured, wherein an articulated linkage is arranged to project the piston plate into the container permitting periodic extraction of water from the chamois.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chamois water extraction apparatus which has all the advantages of the prior art water extraction apparatus and none of the disadvantages.

It is another object of the present invention to provide a new and improved chamois water extraction apparatus which may be easily and efficiently manufactured and marketed.

It is a further object of the present invention to provide a new and improved chamois water extraction apparatus which is of a durable and reliable construction.

An even further object of the present invention is to provide a new and improved chamois water extraction apparatus which is susceptible of a low cost of manufacture with regard to both materials and labor, and which accordingly is then susceptible of low prices of sale to the consuming public, thereby making such chamois water extraction apparatus economically available to the buying public.

Still yet another object of the present invention is to provide a new and improved chamois water extraction apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
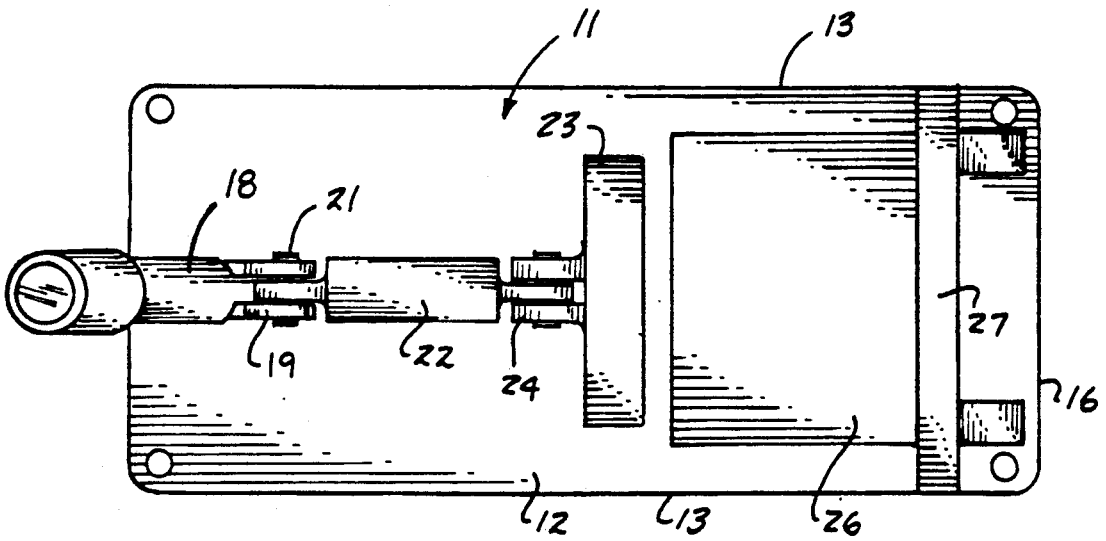
FIG. 1 is an orthographic top view of the press plate structure in cooperation with the receiving cylinder.
Figure 2:
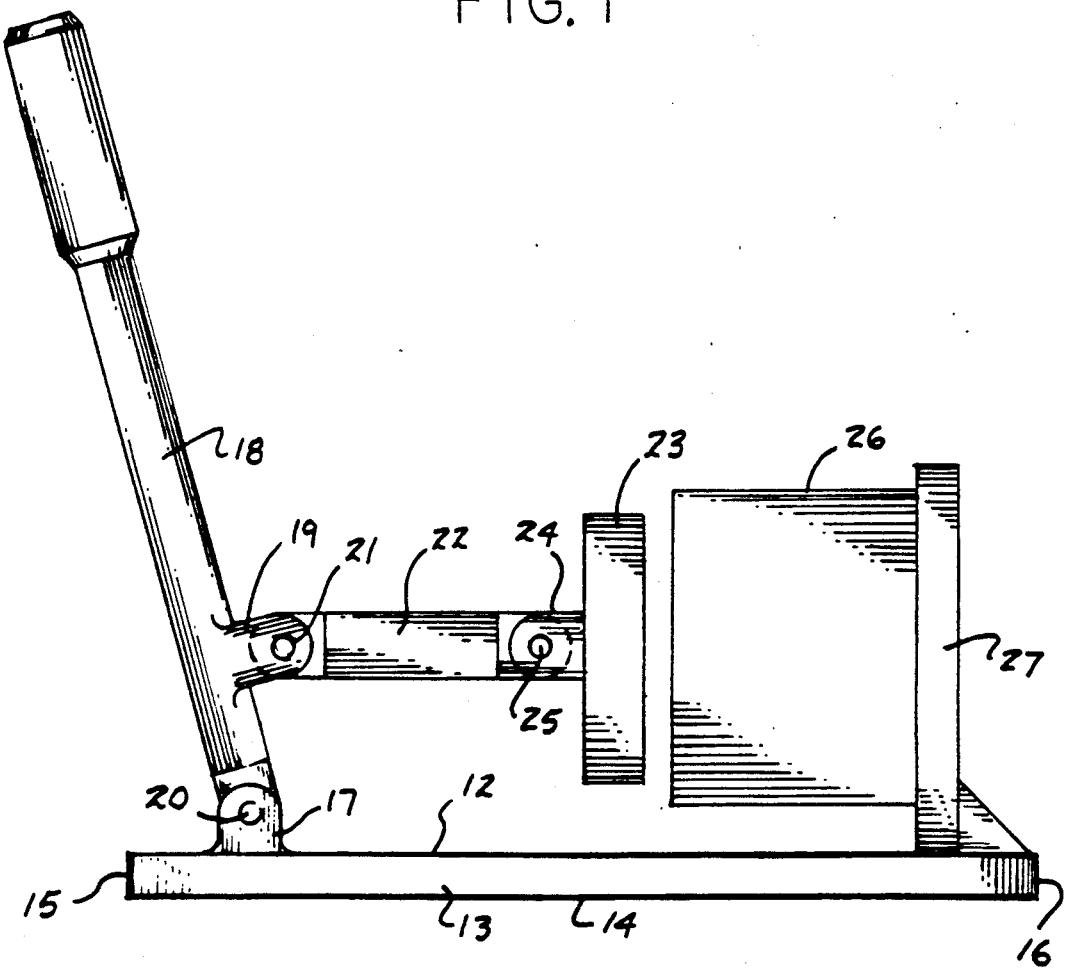
FIG. 2 is an orthographic side view of the invention, as indicated in FIG. 1.

With reference now to the drawings, and in particular to FIGS. 1 to 7 thereof, a new and improved chamois water extraction apparatus embodying the principles and concepts of the present invention and generally designated by the reference numeral 10 will be described.

More specifically, the chamois water extraction apparatus 10 of the instant invention essentially comprises a base plate 11 having a front wall 12 spaced from a rear wall 14, spaced side walls 13, with a top wall 15 spaced from a bottom wall 16. A bifurcated support 17 is fixedly mounted to the front wall 12 in adjacency to the top wall 15 pivotally mounting an actuator lever 18 about a first axle 20. The actuator lever 18 includes a bifurcated lever pivot boss 19 mounted fixedly to the actuator lever 18 in spaced adjacency to the bifurcated support 17. A second axle 21 pivotally mounts a drive link 22 at a first end of the drive link to the second axle 21 within the pivot boss 19. The drive link second end includes a piston 23 mounted thereto about a third axle 25, with the bifurcated piston rod 24 mounted to a piston 23 medially thereof. A receiving container 26 is provided having a container floor 32 (see FIG. 4), with the container floor having container floor apertures 33 for drainage. A support plate 27 is fixedly mounted to the front wall 12 in adjacency to the bottom wall 16, having a support plate cylindrical recess 27*a* for positioning the receiving container 26 coaxially aligned with the piston 23. The recess includes a matrix of drain apertures 28 therethrough.

In this manner, a chamois member is merely positioned within the container 26, the articulated linkage to include the actuator lever 18, the drive link 22, and the piston 23 captures the chamois between the piston 23 and the container floor 32 to direct excess fluid from the chamois through the drain apertures 28, as well as the container floor apertures 33. The recess 27*a* removably mounts the container and the structures aligns such. The base plate 11 is mounted to a vertical wall surface.

Figure 3:
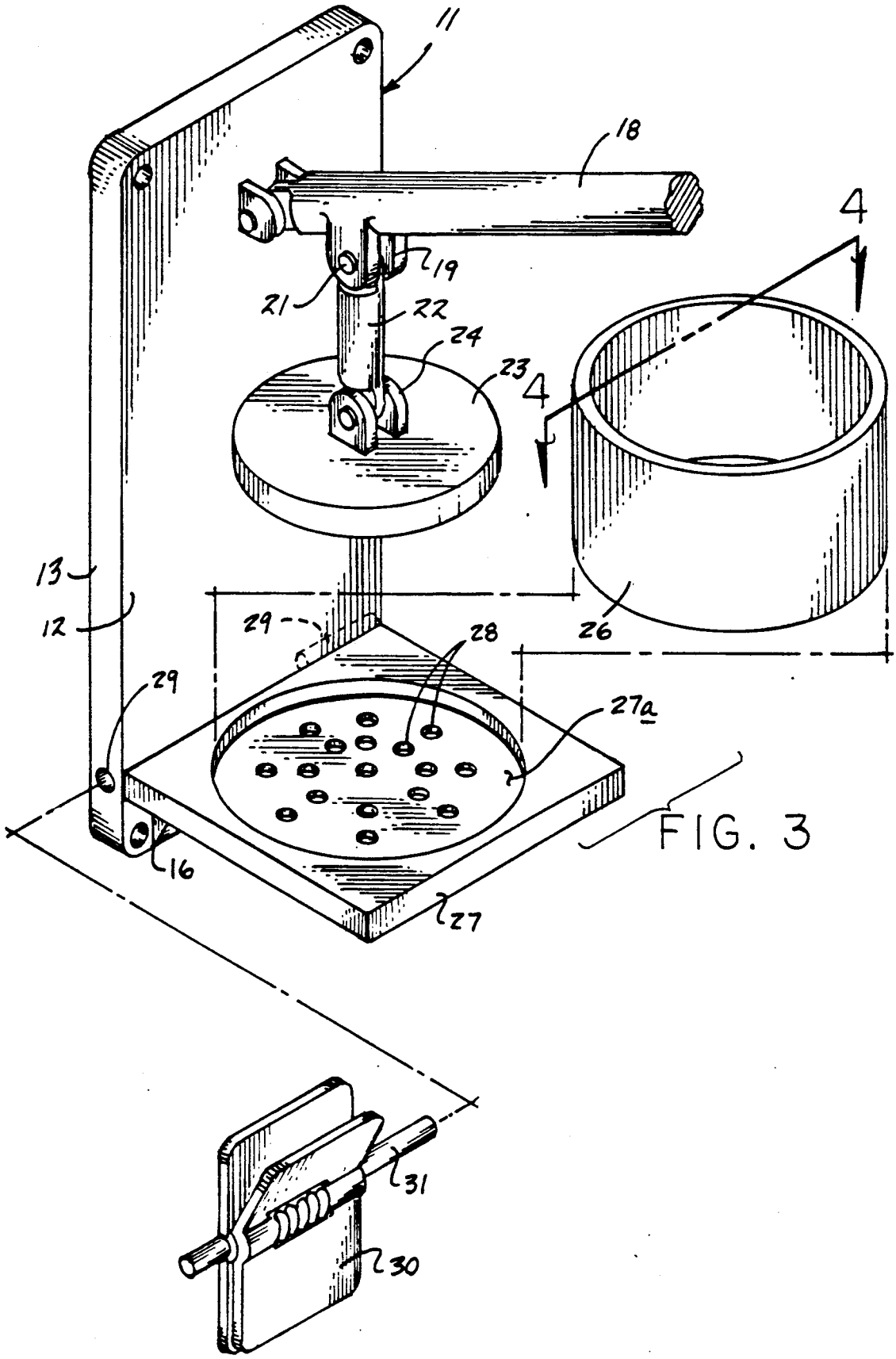
FIG. 3 is an isometric illustration of the invention arranged to further employ a support clip member.

The FIG. 3 indicates the use of spaced side wall mounting bores 29 directed into each of the side walls in a coaxially aligned relationship relative to one another such that, as illustrated in FIG. 3, a support clamp 30 having spring-biased facing jaws includes a mounting rod 31, that in turn is received within one of the mounting bores 29.

Figures 4, 5:
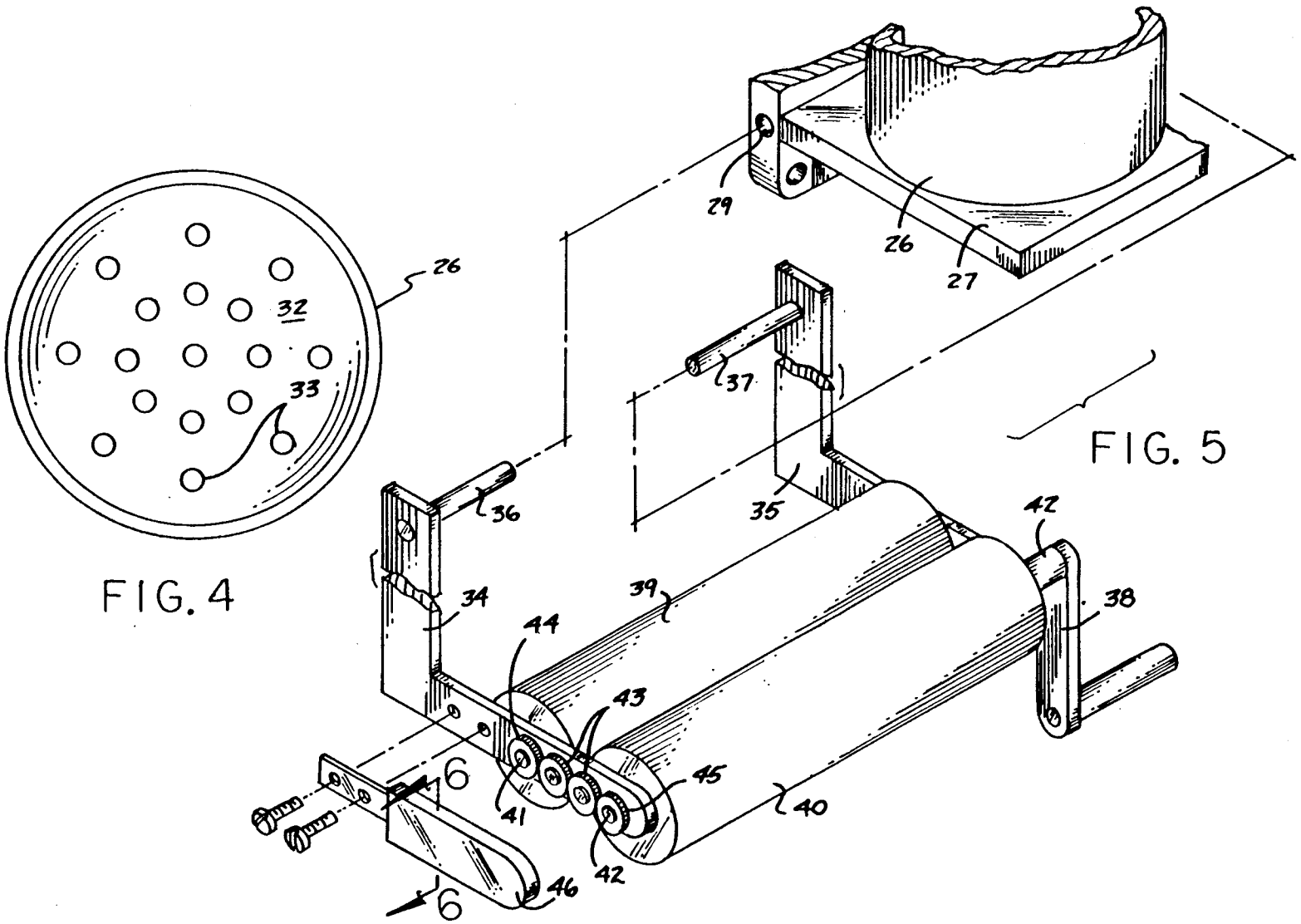
FIG. 4 is an orthographic view, taken along the lines 4—4 of FIG. 3 in the direction indicated by the arrows.
FIG. 5 is an isometric illustration of the invention to selectively employ a wringer apparatus.

The FIG. 5 as well the FIG. 7 indicates the use of a wringer structure, for additional removal of water, mounted to the base plate 11 below the support plate 27. The wringer structure includes first and second L-shaped support flanges 34 and 35 arranged in a parallel spaced relationship having respective first and second flange mounting rods 36 and 37 received within an individual one of the mounting bores 29. First and second drain rollers 39 and 40 mounted about respective first and second roller axles 41 and 42 are parallel relative to one another and rotatably mounted through the respective first and second support flanges 34 and 35. Intermediate gears 43 are mounted between the first and second roller axles 41 and 42, with the first roller axle having a first gear 44 and the second roller axle having a second gear 45, with the first and second gears 44 and 45 in engagement with the intermediate gears 43 to provide for the rollers 39 and 40 to rotate in opposite directions upon the rotation of the second roller axle 42, that in turn includes a drive handle 38. The intermediate gears 43, as well as the first and second gears 44 and 45, include a gear cover cap 46, as illustrated in the FIG. 5 for example.

Figures 6, 7:
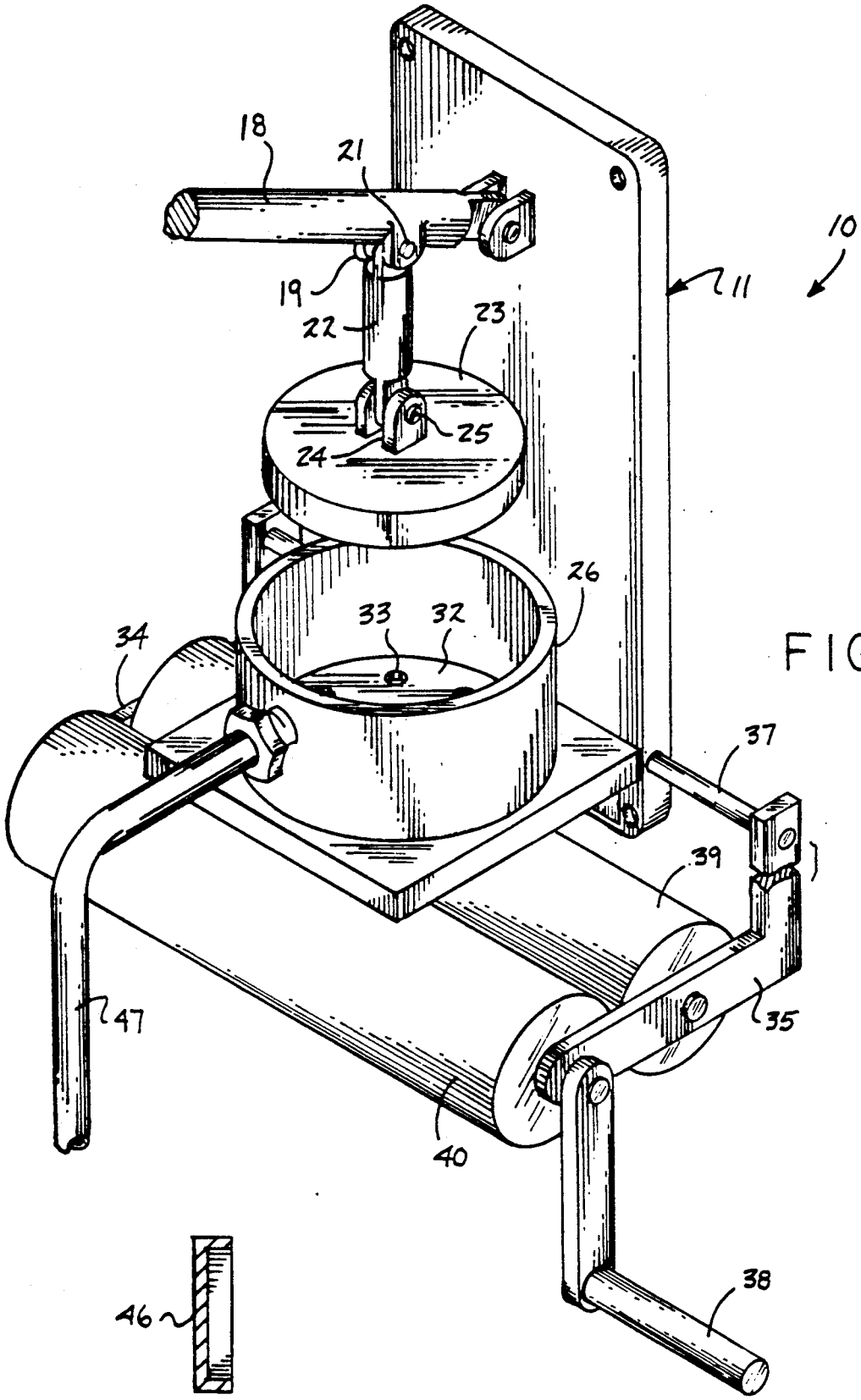
FIG. 6 is an orthographic view, taken along the lines 6—6 of FIG. 5 in the direction indicated by the arrows.
FIG. 7 is an isometric illustration of the wringer structure in use.

The FIG. 7 illustrates the use of water flushing conduit 47 directed into the container through the container side wall to permit the mounting of pressurized water to permit flushing of a chamois within the container when such chamois' are contaminated by various debris that are picked up during a drying procedure.

It should be further noted that the first, second, and third axles 20, 21, and 25 are arranged in a parallel relationship relative to one another to permit the articulating linkage to function in a smooth manner, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chamois water extraction apparatus, comprising, a base plate, the base plate including a front wall, a rear wall, a top wall spaced from a bottom wall, and spaced side walls, wherein the front wall includes an articulate linkage pivotally mounted thereto, the articulate linkage includes a bifurcated support extending from said front wall having a first axle, with an actuator lever mounted to the first axle and to the bifurcated support, and the actuator lever includes a pivot boss, the pivot boss having a second axle, and a drive link, the drive link including a drive link first end and a drive link second end, the drive link first end pivotally mounted about the second axle, and the drive link second end including a third axle directed therethrough, and a piston, the piston including a bifurcated piston rod, with the third axle directed through the bifurcated piston rod, with the first axle, the second axle, and the third axle arranged in a parallel relationship relative to one another, and a support plate fixedly mounted to the front wall in adjacency to the bottom wall, with the support plate removably mounting a container, the support plate having support plate apertures, the container having a container floor, with the container floor having container floor apertures, with the piston complementarily received within the container to permit a fluid to be directed through the support plate apertures and the container floor apertures, and a mounting bore directed into each side wall, wherein said bores are coaxially aligned with one another, wringer means for additional removal of water from a chamois member, wherein the wringer means includes first and second L-shaped support flanges arranged in a parallel spaced relationship, wherein the first L-shaped support flange includes a first mounting rod, the second L-shaped support flange includes a second mounting rod, the first mounting rod is received within one of said mounting bores, and the second mounting rod is received into the other one of said mounting bores, and a first roller axle rotatably mounted between and to the first and second L-shaped support flanges, and a second roller axle parallel to the first roller axle, with the second roller axle rotatably mounted between and to the first and second L-shaped support flanges, the first roller axle having a first gear mounted thereon, the second roller axle having a second gear mounted thereon, and a plurality of meshing intermediate gears mounted to one of the L-shaped support flanges and in meshing engagement with the first gear and the second gear, the second roller axle having a crank handle attached thereto.

2. An apparatus as set forth in claim 1 including a fluid conduit coupled with and directed into the container to direct flushing fluid into the container through the conduit.

* * * * *